US005387571A

United States Patent [19]

Daly

[11] Patent Number: 5,387,571

[45] Date of Patent: Feb. 7, 1995

[54] THERMAL DYE TRANSFER RECEIVING ELEMENT WITH POLYESTER DYE IRMAGE-RECEIVING LAYER

[75] Inventor: Robert C. Daly, Rochester, N.Y.

[73] Assignee: Eastman Kodak Company, Rochester, N.Y.

[21] Appl. No.: 801,223

[22] Filed: Dec. 3, 1991

[51] Int. Cl.[6] ..... B41M 5/035; B41M 5/38

[52] U.S. Cl. ..... 503/227; 428/195; 428/480; 428/913; 428/914

[58] Field of Search ..... 8/471; 428/195, 480, 428/913, 914; 503/227

[56] References Cited

U.S. PATENT DOCUMENTS

| | | | |
|---|---|---|---|
| 3,256,241 | 6/1966 | Watson | 260/47 |
| 3,725,343 | 4/1973 | Schreyer | 260/42 C |
| 3,754,909 | 8/1973 | Feltzin et al. | 96/1.5 |
| 3,787,526 | 1/1974 | Burns et al. | 260/860 |
| 4,612,362 | 9/1986 | Lai et al. | 528/190 |
| 4,740,497 | 4/1988 | Harrison et al. | 503/227 |
| 4,814,417 | 3/1989 | Sugimori | 528/182 |
| 4,897,377 | 1/1990 | Marbrow | 503/227 |
| 4,912,085 | 3/1990 | Marbrow | 503/227 |
| 4,914,179 | 4/1990 | Morris et al. | 528/272 |
| 4,927,803 | 5/1990 | Bailey et al. | 503/227 |
| 4,950,736 | 8/1990 | Sasaki et al. | 528/370 |
| 4,980,448 | 12/1990 | Tajiri et al. | 528/194 |
| 4,985,536 | 1/1991 | Figuly | 528/272 |

FOREIGN PATENT DOCUMENTS

| | | | |
|---|---|---|---|
| 0475633 | 3/1992 | European Pat. Off. | 503/227 |
| 4-133795 | 5/1992 | Japan | 503/227 |

*Primary Examiner*—B. Hamilton Hess
*Attorney, Agent, or Firm*—Harold E. Cole

[57] ABSTRACT

A dye-receiving element for thermal dye transfer includes a support having on one side thereof a dye image-receiving layer. Receiving elements of the invention are characterized in that the dye image-receiving layer or an overcoat layer thereon comprises a polyester comprising recurring dibasic acid derived units and diol derived units, at least 50 mole % of the dibasic acid derived units comprising dicarboxylic acid derived units containing an alicyclic ring within two carbon atoms of each carboxyl group of the corresponding dicarboxylic acid, and at least 30 mole % of the diol derived units containing an aromatic ring not immediately adjacent to each hydroxyl group of the corresponding diol or an alicyclic ring.

21 Claims, No Drawings

THERMAL DYE TRANSFER RECEIVING ELEMENT WITH POLYESTER DYE IRMAGE-RECEIVING LAYER

This invention relates to dye-receiving elements used in thermal dye transfer, and more particularly to polymeric dye image-receiving or overcoat layers for such elements.

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals, and the process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Dye donor elements used in thermal dye transfer generally include a support bearing a dye layer comprising heat transferable dye and a polymeric binder. Dye receiving elements generally include a support bearing on one side thereof a dye image-receiving layer. The dye image-receiving layer conventionally comprises a polymeric material chosen for its compatibility and receptivity for the dyes to be transfered from the dye donor element.

Polycarbonates (the term "polycarbonate" as used herein means a polyester of carbonic acid and a diol or diphenol) and polyesters have been suggested for use in image-receiving layers. Polycarbonates (such as those disclosed in U.S. Pat. Nos. 4,740,497 and 4,927,803) have been found to possess good dye uptake properties and desirable low fade properties when used for thermal dye transfer; however, they are generally made in solution from hazardous materials (e.g. phosgene and chloroformares) and isolated by precipitation into another solvent. The recovery and disposal of solvents coupled with the dangers of handling phosgene make the preparation of specialty polycarbonates a high cost operation. Polyesters, on the other hand, can be readily synthesized and processed by melt condensation using no solvents and relatively innocuous chemical starting materials. Polyesters formed from aromatic diesters (such as disclosed in U.S. Pat. No. 4,897,377) generally have good dye up-take properties when used for thermal dye transfer; however, they exhibit severe fade when the dye images are subjected to high intensity daylight illumination. Polyesters formed from aliphatic diesters generally have relatively low glass transition temperatures (Tg), which frequently results in receiver-to-donor sticking at temperatures commonly used for thermal dye transfer. When the donor and receiver are pulled apart after imaging, one or the other fails and tears and the resulting images are unacceptable.

Accordingly, it would be highly desirable to provide an easily manufacturable receiver element for thermal dye transfer processes having excellent dye uptake and image stability and which would not stick to dye donor elements.

These and other objects are achieved in accordance with this invention which comprises a dye-receiving element for thermal dye transfer comprising a support having on one side thereof a dye image-receiving layer, wherein the dye image-receiving layer or an overcoat layer thereon comprises a polyester comprising recurring dibasic acid derived units and diol derived units, at least 50 mole % of the dibasic acid derived units comprising dicarboxylic acid derived units containing an alicyclic ring within two carbon atoms of each carboxyl group of the corresponding dicarboxylic acid, and at least 30 mole % of the diol derived units containing an aromatic ring not immediately adjacent to each hydroxyl group of the corresponding diol or an alicyclic ring.

The polymers used in the dye-receiving elements of the invention are condensation type polyesters based upon recurring units derived from alicyclic dibasic acids (Q) and diols (L) wherein (Q) represents one or more alicyclic ring containing dicarboxylic acid units with each carboxyl group within two carbon atoms of (preferably immediately adjacent) the alicyclic ring and (L) represents one or more diol units each containing at least one aromatic ring not immediately adjacent to (preferably from 1 to about 4 carbon atoms away from) each hydroxyl group or an alicyclic ring which may be adjacent to the hydroxyl groups. For the purposes of this invention, the terms "dibasic acid derived units" and "dicarboxylic acid derived units" are intended to define units derived not only from carboxylic acids themselves, but also from equivalents thereof such as acid chlorides, acid anhydrides and esters, as in each case the same recurring units are obtained in the resulting polymer. Each alicyclic ring of the corresponding dibasic acids may also be optionally substituted, e.g. with one or more $C_1$ to $C_4$ alkyl groups. Each of the diols may also optionally be substituted on the aromatic or alicyclic ring, e.g. by $C_1$ to $C_6$ alkyl, alkoxy, or halogen.

In a preferred embodiment of the invention, the alicyclic rings of the dicarboxylic acid derived units and diol derived units contain from 4 to 10 ring carbon atoms. In a particularly preferred embodiment, the alicyclic rings contain 6 ring carbon atoms.

The alicyclic dicarboxylic acid units, (Q), are represented by structures such as:

Q1:

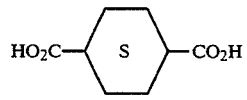

Q2:

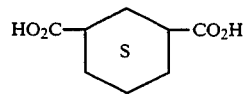

-continued
Q3:
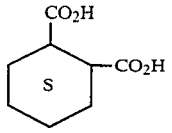
Q4:
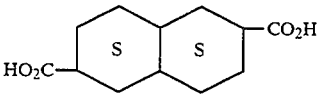
Q5:
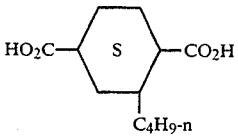
Q6:
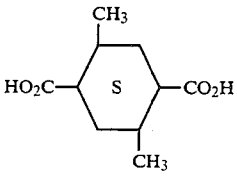
-continued
Q7:
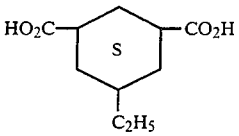
Q8:
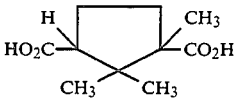
Q9:
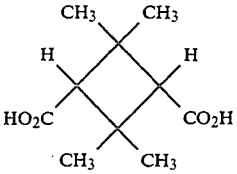
Q10:
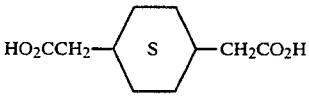
The diols, (L), are represented by structures such as:
L1:
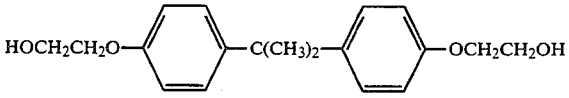
L2:
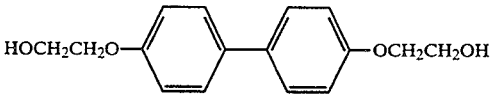
L3:
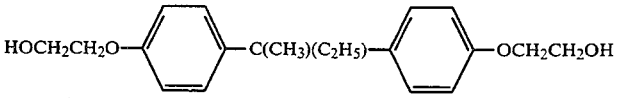
L4:
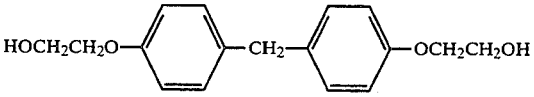
L5:
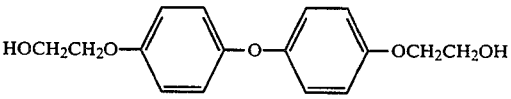
L6:
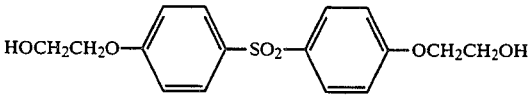
L7:
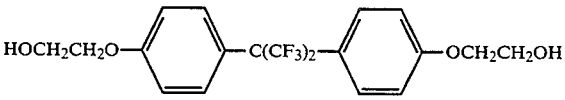
L8:
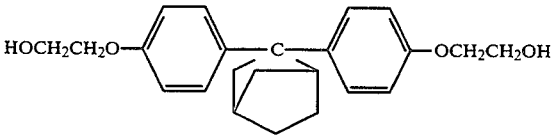

-continued
L9:
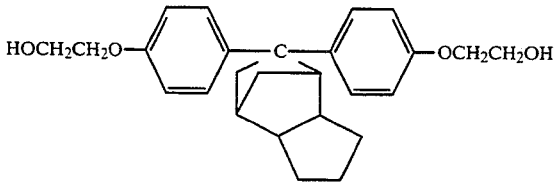
L10:
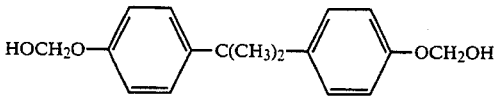
L11:
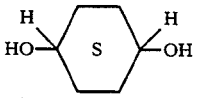
L12:
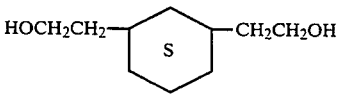
L13:
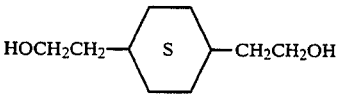
L14:
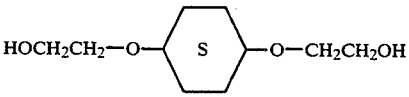
L15:
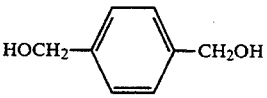
L16:
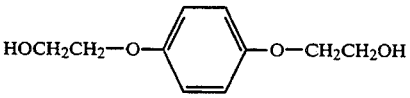
L17:
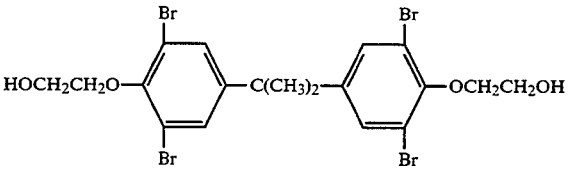
L18:
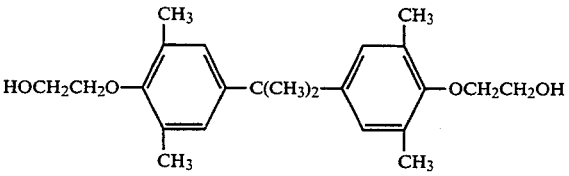
L19:
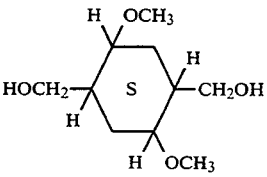

-continued

L20:

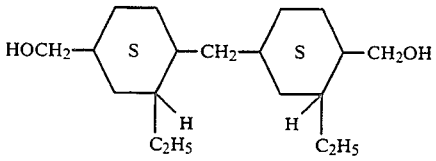

L21:

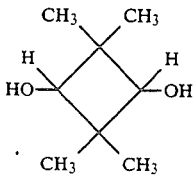

L22:

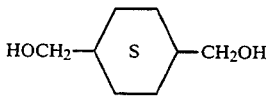

L23:

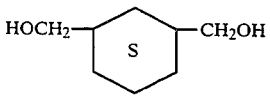

Optionally other groups, R and M, may be copolymerized to produce structures such as:

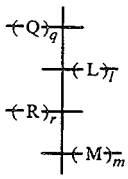

wherein q+r=1+m=100 mole % and q is at least 50 mole percent and 1 is at least 30 mole percent.

Suitable groups for R include dibasic aliphatic acids such as:

R1: $HO_2C(CH_2)_2CO_2H$
R2: $HO_2C(CH_2)_4CO_2H$
R3: $HO_2C(CH_2)_7CO_2H$
R4: $HO_2C(CH_2)_{10}CO_2H$

Suitable groups for M include diols such as:

M1: $HOCH_2CH_2OH$
M2: $HO(CH_2)_4OH$
M3: $HO(CH_2)_9OH$

M4: $HOCH_2C(CH_3)_2CH_2OH$
M5: $(HOCH_2CH_2)_2O$

M6: $HO(CH_2CH_2O)_nH$ (where n=2 to 50)

The dibasic acid units and diol units may also be copolymerized with other monomer units conventionally used in receiver polymers. Functional group terminated block polysiloxane units may also be copolymerized with the dibasic acid units and diol units combinations of the invention to form a linear condensation copolymer as disclosed in copending, commonly assigned U.S. Ser. No. 07/665,613 of Harrison et al., filed Mar. 6, 1991, the disclosure of which is hereby incorporated by reference.

Polymers are preferred that have a glass transition temperature, Tg, of greater than 40° C., and more preferably between 40° and 100° C. Preferred number molecular weights for the polymers of the invention are from about 10,000 to about 250,000, more preferably from 20,000 to 100,000.

The following polymers E-1 through E-17 (comprised of recurring units of the illustrated monomers) are examples of polymers according to the invention.

E-1 to E-5: Polymers which are preferred and considered to be derived from 1,4-cyclohexanedicarboxylic acid, ethylene glycol, and 4,4'-bis (2-hydroxyethyl) bisphenol-A.

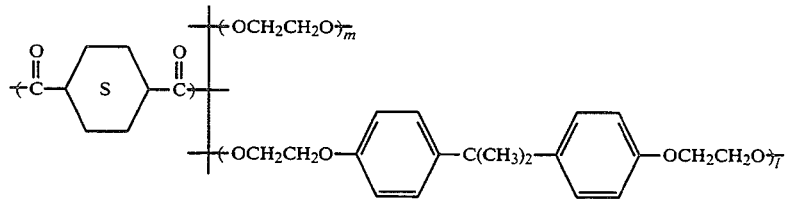

| | | | |
|---|---|---|---|
| E-1: | l = 50 mole % | m = 50 mole % | Tg = 51° C. |
| E-2: | l = 60 mole % | m = 40 mole % | |
| E-3: | l = 30 mole % | m = 70 mole % | |
| E-4: | l = 75 mole % | m = 25 mole % | Tg = 71° C. |
| E-5: | l = 85 mole % | m = 15 mole % | |

E-6: A polymer considered to be derived from 1,4-cyclohexanedicarboxylic acid and 4,4'-bis(2-hydroxyethyl) bisphenol-A

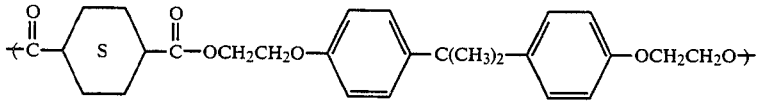

E-7 & E-8: Polymers considered to be derived from 1,4-cyclohexanedicarboxylic acid, ethylene glycol and 1,4-cyclohexanedimethanol

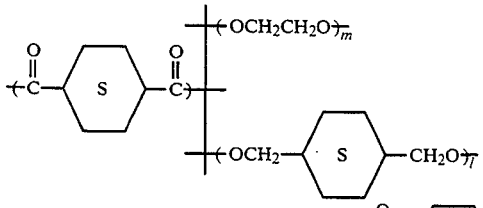

E-7: l = 50 mole % m = 50 mole %
E-8: l = 70 mole % m = 30 mole %

E-9: A polymer considered to be derived from 1,4-cyclohexanedicarboxylic acid and 1,4-cyclohexane dimethanol

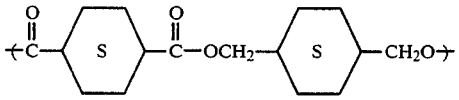

E-10 & E-11: Polymers considered to be derived from 1,4-cyclohexanedicarboxylic acid, 4,4'-bis (hydroxyethyl) bisphenol-A, and 4,4'- (2-norbornylidene) -bis (2-hydroxyethyl)bisphenol

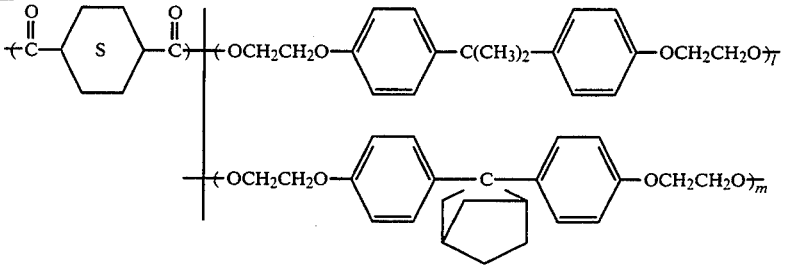

E-10: l = 80 mole % m = 20 mole %
E-11: l = 90 mole % m = 10 mole %

E-12 & E-13: Polymers considered to be derived from 1,4-cyclohexanedicarboxylic acid, ethylene glycol, and 4,4'- (2-norbornylidene)-bis(2-hydroxyethyl) bisphenol

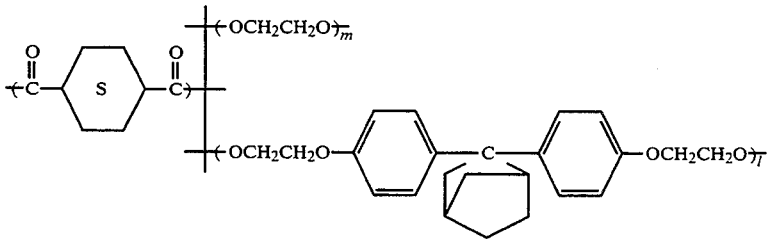

E-12: l = 30 mole % m = 70 mole %
E-13: l = 50 mole % m = 50 mole %

E-14: A polymer considered to be derived from 1,4-cyclohexanedicarboxylic acid, ethyleneglycol, and 4,4'-(hexahydro-4,7-methanoindene-5-ylidene)-bis(2-hydroxyethyl)bisphenol

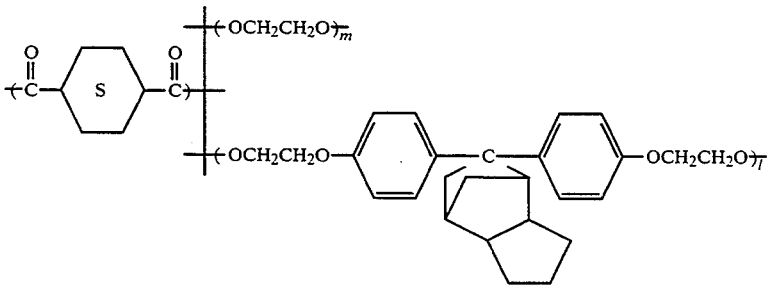

-continued l = 50 mole % m = 50 mole %

E-15: A polymer considered to be derived from 1,4-cyclohexanedicarboxylic acid, azelaic acid, ethylene glycol and 4,4'-bis(2-hydroxyethyl)bisphenol-A

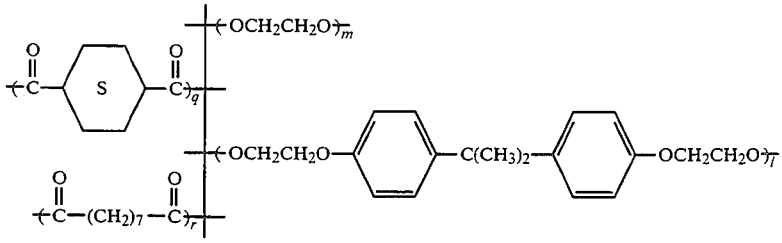

q = 75 mole % r = 25 mole % l, m = 50 mole %

E-16 & E-17: A polymer considered to be derived from 1,3-cyclohexanedicarboxylic acid, ethylene glycol, 4,4'-bis (2-hydroxyethyl)bisphenol-A

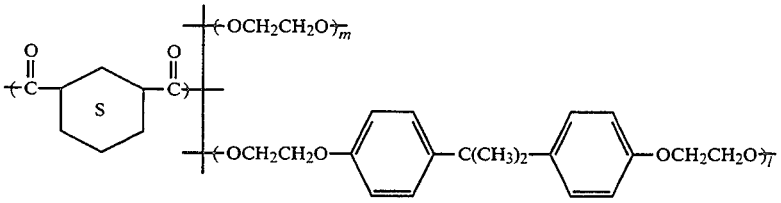

E-16: l = 50 mole % m = 50 mole %
E-17: l = 90 mole % m = 10 mole %

Other polymers within the scope of the invention include E-18 to E-31 listed below:

| Polymer | Alicyclic Diacid Mole % O | Alternate Diacid Mole % R | Glycol Mole % L | Alternate Glycol Mole % M |
|---|---|---|---|---|
| E-18 | 100% Q1 | — | 30% L2 | 70% M1 |
| E-19 | 100% Q1 | — | 50% L9 | 48% M1<br>2% M6 (n~35) |
| E-20 | 100% Q1 | — | 50% L13 | 50% M1 |
| E-21 | 100% Q1 | — | 50% L21 | 50% M1 |
| E-22 | 100% Q2 | — | 70% L11 | 30% M1 |
| E-23 | 100% Q2 | — | 100% L16 | — |
| E-24 | 70% Q2 | 30% R2 | 50% L21,<br>50% L11 | — |
| E-25 | 50% Q1,<br>50% Q2, | — | 50% L1 | 50% M1 |
| E-26 | 50% Q1,<br>50% Q2, | — | 100% L5 | — |
| E-27 | 100% Q4 | — | 100% L10 | — |
| E-28 | 70% Q4 | 30% R1 | 50% L1 | 50% M1 |
| E-29 | 100% Q6 | — | 100% L14 | — |
| E-30 | 100% Q7 | — | 50% L14 | 50% M4 |
| E-31 | 100% Q8 | — | 30% L6 | 70% M1 |

The support for the dye-receiving element of the invention may be a polymeric, a synthetic paper, or a cellulosic paper support, or laminates thereof. In a preferred embodiment, a paper support is used. In a further preferred embodiment, a polymeric layer is present between the paper support and the dye image-receiving layer. For example, there may be employed a polyolefin such as polyethylene or polypropylene. In a further preferred embodiment, white pigments such as titanium dioxide, zinc oxide, etc., may be added to the polymeric layer to provide reflectivity. In addition, a subbing layer may be used over this polymeric layer in order to improve adhesion to the dye image-receiving layer. Such subbing layers are disclosed in U.S. Pat. Nos. 4,748,150, 4,965,238, 4,965,239, and 4,965,241, the disclosures of which are incorporated by reference. The receiver element may also include a backing layer such as those disclosed in U.S. Pat. No. 5,011,814 of Harrison and U.S. Ser. No. 07/547580 of Martin, the disclosures of which are incorporated by reference.

The invention polymers may be used in a receiving layer alone or in combination with other receiving layer polymers. The polymers may be used in the receiving layer itself, or in an overcoat layer. The use of overcoat layers is described in U.S. Pat. No. 4,775,657 of Harrison et al., the disclosure of which is incorporated by reference. Receiving layer polymers which may be overcoated or blended with the polymers of the invention include polycarbonates, polyurethanes, polyesters, polyvinyl chlorides, poly(styrene-co-acrylonitrile), poly(caprolactone) or any other receiver polymer and mixtures thereof.

The dye image-receiving and overcoat layers may be present in any amount which is effective for their intended purposes. In general, good results have been obtained at a receiver layer concentration of from about 1 to about 10 g/m$^2$ and an overcoat layer concentration of from about 0.01 to about 3.0 g/m$^2$, preferably from about 0.1 to about 1 g/m$^2$.

Receivers can also be fabricated from the melt of the polyesters of this invention. The polyesters can be cast as a melt on paper, polyolefin coated paper, or a sheet of thermoplastic resin by the process of extrusion coating. Rather than dissolving the polymer in a solvent which will have to be removed later, the fluid polymer melt is squeezed out of a thin die and onto the support which moves through the melt curtain. Similarly, these polyesters may be extruded simultaneously with other polymer melts in a process of coextrusion. The layers coextruded with these polyesters could be the backing, support, intermediate layers, or overcoat for the receiver element. In the simplest case, the polyesters of this invention may be extruded thick enough to serve as both support and receiver layer to yield a single step manufacturing process. Extrusion and coextrusion techniques are well known in the art and are described, e.g., in *Encyclopedia of Polymer Science and Engineering,* Vol. 3, John Wiley, New York, 1985, p. 563, and *Encyclopedia of Polymer Science and Engineering,* Vol. 6, john Wiley, New York, 1986, p. 608, the disclosures of which are incorporated by reference.

Dye-donor elements that are used with the dye-receiving element of the invention conventionally comprise a support having thereon a dye containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112, 4,927,803 and 5,023,228, the disclosures of which are incorporated by reference.

As noted above, dye-donor elements are used to form a dye transfer image. Such a process comprises image-wise-heating a dye-donor element and transferring a dye image to a dye-receiving element as described above to form the dye transfer image.

In a preferred embodiment of the invention, a dye-donor element is employed which comprises a poly(ethylene terephthalate) support coated with sequential repeating areas of cyan, magenta and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements of the invention are available commercially. There can be employed, for example, a Fujitsu Thermal Head (FTP-040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage of the invention comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to further illustrate the invention. The synthesis example is representative, and other polymers of the invention may be prepared analogously or by other methods know in the art.

Synthesis

Preparation of polyester E-1 derived from 1,4-cyclohexanedicarboxylic acid, ethylene glycol (50 mole percent) and 4,4'-bis(2-hydroxyethyl)bisphenol-A (50 mole percent).

This polymer was synthesized using a standard melt condensation of a 70:30 cis:trans mixture of dimethyl 1,4-cyclohexane dicarboxylate with 4,4'-bis(2-hydroxyethyl) bisphenol-A and an excess of ethylene glycol.

To a single neck side-arm 500 mL polymerization flash fitted with a 38 cm head was added dimethyl 1,4-cyclohexane dicarboxylate (104.8g, 0.54 mol), 4,4'-bis(2-hydroxyethyl)bisphenol-A (84.5g, 0.27 mol), ethylene glycol (60.4g, 1.1 mol), zinc acetate dihydrate (0.4g), antimony trioxide (0.3g), and Irganox 1010 (Ciba Geigy) (0.25g). The flask was heated to 220° C. in a salt bath and continuously flushed with nitrogen for distillation of methanol. After two hours the calculated amount of methanol had been distilled and the temperature was raised to 240° C. for 30 minutes. Trioctylphosphate (8 drops) was added and the temperature was increased to 275° C.

The flask was reconfigured for mechanical stirring and evacuation. The pressure was slowly reduced to 0.4 mm mercury over 15 minutes to allow excess ethylene glycol to distill. The progress of the reaction was monitored by measuring the power required to maintain a constant torque of 200 rpm. The reaction was terminated when the power required reached 180 mv. The flask was cooled to room temperature, rinsed with water and then was broken to remove the polymer ball. The polymer was cooled to liquid nitrogen temperature, broken into centimeter-sized pieces and ground in a Wiley Mill. The yield of polymer was 172 g; the Tg was 51.6° C. and the number average molecular weight by size exclusion chromatography was 30,700.

The other polymers of the examples were prepared in similar manner to polymer E-1.

EXAMPLE

Solvent coated dye-receivers were prepared by coating the following layers on white-reflective supports of titanium dioxide pigmented polyethylene overcoated paper stock:

(1) subbing layer of poly(acrylonitrile-co-vinylidene chloride-co-acrylic acid) (14:79:7 wt. ratio)(0.08 g/m$^2$) from butanone solvent.

(2) receiver layer of the indicated polyester of the invention (3.2 g/m$^2$) from dichloromethane Extrusion coated dye-receivers were prepared by feeding pre-dried polyester (45° C. for 24 hours prior to extrusion coating) to a Brebender extruder heated to 175° C. to melt the polymer. The molten polymer was pushed out of the extruder die and applied to corona discharge treated raw paper stock. The polymer/paper structure was pressed between a rubber roller at the back of the paper and a polished metal chill roller held at 15° C. which contacted the polymer which had been laid on the paper. The extrusion coated receiver was then stripped from the chill roller.

Control dye-receivers were solvent coated as described above except the following polymers (3.2 g/m$^2$) were coated in the receiver layer:

C-1: A polymer derived from terephthalic acid, ethylene glycol (50 mole %), and 4,4'-bis(2-hydroxyethyl)bisphenol-A (50 mole %). Like polymer E-1 but with an aromatic acid rather than the alicyclic dicarboxylic acid, Tg=80° C.

C-2: A polymer derived from suberic acid, ethylene glycol (50 mole %) and 4,4'-bis (2-hydroxyethyl) bisphenol-A (50 mole %). Like polymer E-1 but with an aliphatic dibasic acid, Tg=−5° C.

C-3: A polymer of the E-1 to E-5 class which only contained 25 mole percent of the 4,4'-bis(2-hydroxyethyl)bisphenol-A component resulting in a Tg of only 37° C.

C-4: A polymer derived from 1,4-cyclohexane-dicarboxylic acid and ethylene glycol C-5: A polymer derived from terephthalic acid, ethylene glycol (30 mole %) and 1,4-cyclohexane-dimethanol (70 mole %). Like polymer E-8 except with an aromatic diacid rather than the alicyclic dicarboxylic acid C-6: A polymer derived from terephthalic acid, ethylene glycol (50 mole %) and 4,4' [hexahydro-4,7-methanindene-5-ylidene)bis(2-hydroxyethylphenol)] (50 mole %). Like polymer E-14 but with an aromatic diacid rather than the alicyclic dicarboxylic acid C-7: A polymer derived from isophthalic acid, ethylene glycol (50 mole %) and 4,4'-bis (2-hydroxyethyl)bisphenol-A (50 mole %). Like polymer E-16 but with an aromatic diacid rather than the alicyclic dicarboxylic acid, Tg=70° C.

A yellow dye-donor element was prepared by coating the following layers on a 6 μm poly(ethylene terephthalate) support:

1) subbing layer of Tyzor TBT (a titanium-n-butoxide) (du Pont Co.) (0.12 g/m²) from a n-propyl acetate and 1-butanol solvent mixture, 2) dye-layer of the yellow dye (illustrated below) (0.22 g/m²) and S-363 (a micronized blend of polypropylene and polyethylene particles) (Shamrock Technologies, Inc.) (0.02 g/m²) in a cellulose acetate-propionate binder (2.5% acetyl, 46% propionyl), (0.45 g/m²) from a toluene, methanol, and cyclopentanone solvent mixture.

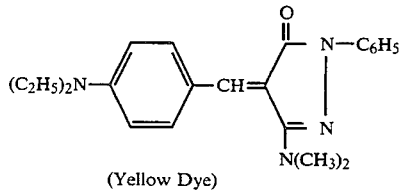

(Yellow Dye)

On the back side of the dye-donor element was coated:

1) subbing layer of Tyzor TBT (0.12 g/m²) from a n-propyl) acetate and 1-butanol solvent mixture, 2) slipping layer of Emralon 329 (polytetrafluoroethylene in cellulose nitrate) (Acheson Colloids) (0.59 g/m²) PS-513 (an aminopropyl terminated polydimethyl siloxane) (Petrarch Systems Inc.) (0.006 g/m²), BYK-320 a polyoxyalkylene-methylalkyl siloxane copolymer (0.006 g/m²), and S-232 (a micronized blend of polyethylene and carnauba wax particles) (Shamrock Technologies, Inc.) (0.016 g/m²) from a n-propyl acetate and 1-butanol solvent mixture.

A cyan dye donor element was prepared as described above except the following cyan dye (0.42 g/m²) and binder (0.66 g/m²) were coated:

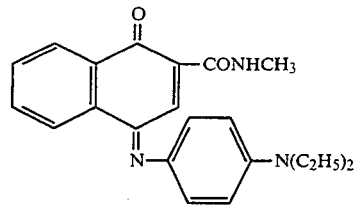

(Cyan Dye)

The dye side of the dye-donor element strip approximately 10 cm×13 cm in area was placed in contact with the dye image-receiving layer of the dye-receiver element of the same area. The assemblage was clamped to a stepper-motor driven 60 mm diameter rubber roller and a TDK Thermal Head (No. L-231) (thermostatted at 26° C.) was pressed with a force of 36N against the dye-donor element side of the assemblage pushing it against the rubber roller.

The imaging electronics were activated causing the donor/receiver assemblage to be drawn between the printing head and roller at 6.9 mm/sec. Coincidentally, the resistive elements in the thermal print head were pulsed for 29 μsec/pulse at 128 μsec intervals during the 33 msec/dot printing time. A stepped density image was generated by incrementally increasing the number of pulses/dot from 0 to 255. The voltage supplied to the print head was approximately 23.5 volts, resulting in an instantaneous peak power of 1.3 watts/dot and a maximum total energy of 9.6 mjoules/dot.

The Status A Blue reflection density of the maximum density step and an intermediate density near 1.0 were read and recorded. In all cases a maximum density of 2.0 or more was obtained showing the receiver polymers effectively accept dye.

The images were then subjected to High-Intensity Daylight fading (HID-fading) for 7 days, 50 kLux, 5400° K., 32° C., approximately 25% RH and the densities were reread. The percent density loss after fade from the intermediate density steps were calculated. The results are set forth in Table I below. All receivers in the table were solvent coated unless indicated otherwise.

TABLE I

| | Status A Blue Density | | | Status A Red Density | | |
|---|---|---|---|---|---|---|
| Polymer | Dmax | Intermed Density | % Dye Loss | Dmax | Intermed Density | % Dye Loss |
| E-1 | 2.3 | 1.0 | 4 | 2.3 | 0.7 | 20 |
| E-1* | 2.2 | 0.9 | 3 | 2.5 | 0.7 | 23 |
| C-1 | 2.3 | 0.9 | 77 | 2.3 | 0.6 | 81 |
| C-2 | ** | ** | ** | ** | ** | ** |
| E-4 | 2.4 | 1.0 | 4 | 2.2 | 0.7 | 22 |
| C-3 | ** | ** | ** | ** | ** | ** |
| C-4 | ** | ** | ** | ** | ** | ** |
| E-8 | 2.3 | 1.4 | 7 | 1.9 | 1.0 | 15 |
| C-5 | *** | *** | *** | *** | *** | *** |
| E-12 | 2.4 | 0.9 | 9 | 2.3 | 0.6 | 19 |
| E-14 | 2.3 | 0.8 | 21 | 2.2 | 0.5 | 41 |
| C-6 | 1.8 | 1.2 | 91 | 1.8 | 0.9 | 34 |
| E-16 | 2.4 | 0.9 | 4 | 2.4 | 0.6 | 19 |
| C-2 | ** | ** | ** | ** | ** | ** |

TABLE I-continued

| Polymer | Status A Blue Density | | | Status A Red Density | | |
|---|---|---|---|---|---|---|
| | Dmax | Intermed Density | % Dye Loss | Dmax | Intermed Density | % Dye Loss |
| C-7 | 2.4 | 1.0 | 23 | 2.3 | 0.7 | 14 |

*Extrusion coated receiver
**Receiver stuck to donor, no density evaluations possible
***This polymer was extensively crystalline and could not be coated thus no evaluations of transferred density or dye loss could be obtained.

The above results show that the polymers of the invention derived from alicyclic dibasic acids produce superior dye-light stability compared to polyesters of aliphatic or aromatic dibasic acids when used as receiver layers.

The invention has been described in detail with particular reference to preferred embodiments thereof, but it will be understood that variations and modifications can be effected within the spirit and scope of the invention.

What is claimed is:

1. In a dye-receiving element for thermal dye transfer comprising a support having on one side thereof a dye image-receiving layer, the improvement wherein the dye image-receiving layer or an overcoat layer provided thereon comprises a polyester comprising recurring dibasic acid derived units and diol derived units, at least 50 mole % of the dibasic acid derived units comprising dicarboxylic acid derived units containing an alicyclic ring within two carbon atoms of each carboxyl group of the corresponding dicarboxylic acid, and at least 30 mole % of the diol derived units containing an aromatic ring not immediately adjacent to each hydroxyl group of the corresponding diol or an alicyclic ring.

2. The element of claim 1, wherein the alicyclic rings of the dicarboxylic acid derived units comprise from 4 to 10 ring carbon atoms.

3. The element of claim 2, wherein the alicyclic rings of the dicarboxylic acid derived units comprise 6 ring carbon atoms.

4. The element of claim 1, wherein the polyester has a number average molecular weight of from 10,000 to 250,000.

5. The element of claim 4, wherein the polyester has a number average molecular weight of from 20,000 to 100,000.

6. The element of claim 1, wherein the polyester has a glass transition temperature greater than about 40° C.

7. The element of claim 6, wherein the polyester has a glass transition temperature between 40° C. and 100° C.

8. The element of claim 1, wherein the dicarboxylic acid derived units are derived from 1,4-cyclohexanedicarboxylic acid and the diol derived units are derived from 0 to 70 mole percent ethylene glycol and 30 to 100 mole percent 4,4'-bis(2-hydroxyethyl) bisphenol-A.

9. The element of claim 1, wherein the dicarboxylic acid derived units are derived from 1,4-cyclohexanedicarboxylic acid and the diol derived units are derived from 0 to 70 mole percent ethylene glycol and 30 to 100 mole percent 1,4-cyclohexanedimethanol.

10. The element of claim 1, wherein the dye image-receiving layer comprises said polyester.

11. The element of claim 1, wherein an overcoat layer on the dye image-receiving layer comprises said polyester.

12. In a process of forming a dye transfer image comprising imagewise-heating a dye-donor element comprising a support having thereon a dye layer and transferring a dye image to a dye-receiving element to form said dye transfer image, said dye-receiving element comprising a support having thereon a dye image-receiving layer, the improvement wherein the dye image-receiving layer or an overcoat layer provided thereon comprises a polyester comprising recurring dibasic acid derived units and diol derived units, at least 50 mole % of the dibasic acid derived units comprising dicarboxylic acid derived units containing an alicyclic ring within two carbon atoms of each carboxyl group of the corresponding dicarboxylic acid, and at least 30 mole % of the diol derived units containing an aromatic ring not immediately adjacent to each hydroxyl group of the corresponding diol or an alicyclic ring.

13. The process of claim 12, wherein the alicyclic rings of the dicarboxylic acid derived units comprise from 4 to 10 ring carbon atoms.

14. The process of claim 13, wherein the polyester has a number average molecular weight of from 10,000 to 250,000.

15. The process of claim 12, wherein the polyester has a glass transition temperature between 40° C. and 100° C.

16. The process of claim 12, wherein the dicarboxylic acid derived units are derived from 1,4-cyclohexanedicarboxylic acid and the diol derived units are derived from 0 to 70 mole percent ethylene glycol and 30 to 100 mole percent 4,4'-bis(2-hydroxyethyl) bisphenol-A.

17. The process of claim 12, wherein the dicarboxylic acid derived units are derived from 1,4-cyclohexanedicarboxylic acid and the diol derived units are derived from 0 to 70 mole percent ethylene glycol and 30 to 100 mole percent 1,4-cyclohexanedimethanol.

18. In a thermal dye transfer assemblage comprising: (a) a dye-donor element comprising a support having thereon a dye layer, and (b) a dye-receiving element comprising a support having thereon a dye image-receiving layer, said dye-receiving element being in a superposed relationship with said dye-donor element so that said dye layer is in contact with said dye image-receiving layer or an overcoat layer thereon; the improvement wherein the dye image-receiving layer or the overcoat layer comprises a polyester comprising recurring dibasic acid derived units and diol derived units, at least 50 mole % of the dibasic acid derived units comprising dicarboxylic acid derived units containing an alicyclic ring within two carbon atoms of each carboxyl group of the corresponding dicarboxylic acid, and at least 30 mole % of the diol derived units containing an aromatic ring not immediately adjacent to each hydroxyl group of the corresponding diol or an alicyclic ring.

19. The assemblage of claim 18, wherein the dicarboxylic acid derived units are derived from 1,4-cyclohexanedicarboxylic acid and the diol derived units are derived from 0 to 70 mole percent ethylene glycol and 30 to 100 mole percent 4,4'-bis(2-hydroxyethyl) bisphenol-A.

20. The assemblage of claim 18, wherein the dicarboxylic acid derived units are derived from 1,4-cyclohexanedicarboxylic acid and the diol derived units are derived from 0 to 70 mole percent ethylene glycol and 30 to 100 mole percent 1,4-cyclohexanedimethanol.

21. A thermal transfer printing system comprising a dye sheet containing a thermal transfer dye and a receiver sheet for receiving the dye from the dye sheet during thermal transfer printing, said receiver sheet comprising a substrate supporting a dye-receiving layer on its surface, characterised in that the main constituent of the dye-receiving layer is a copolyester in which the acid component comprises at least one alicyclic dicarboxylic acid, and the alcohol component comprises at least one alicyclic diol.

* * * * *